US008967784B2

(12) United States Patent
Ram et al.

(10) Patent No.: US 8,967,784 B2
(45) Date of Patent: Mar. 3, 2015

(54) METHOD AND APPARATUS FOR IMPROVING PRINTED IMAGE DENSITY

(75) Inventors: Mirit Ram, Philadelphia, PA (US); Eytan Cohen, Ramana (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 960 days.

(21) Appl. No.: 12/742,480

(22) PCT Filed: Nov. 19, 2007

(86) PCT No.: PCT/US2007/024214

§ 371 (c)(1),
(2), (4) Date: Jul. 12, 2010

(87) PCT Pub. No.: WO2009/067096

PCT Pub. Date: May 28, 2009

(65) Prior Publication Data

US 2011/0199446 A1 Aug. 18, 2011

(51) Int. Cl.

| | |
|---|---|
| ***B41J 2/01*** | (2006.01) |
| ***B41M 7/00*** | (2006.01) |
| ***B41J 11/00*** | (2006.01) |

(52) U.S. Cl.

CPC ..... *B41M 7/0072* (2013.01); *B41J 11/0015* (2013.01); *B41M 2205/12* (2013.01)

USPC ..... 347/101

(58) Field of Classification Search

USPC ..... 347/101, 55, 76, 155

See application file for complete search history.

(56) References Cited

U.S. PATENT DOCUMENTS

| | | | | |
|---|---|---|---|---|
| 3,977,323 | A | 8/1976 | Pressman et al. | |
| 4,155,093 | A * | 5/1979 | Fotland et al. | 347/127 |
| 5,103,260 | A | 4/1992 | Tompkins et al. | |
| 5,576,742 | A * | 11/1996 | Abe | 346/150.1 |
| 6,951,377 | B2 * | 10/2005 | Knoerzer et al. | 347/14 |
| 7,205,041 | B2 | 4/2007 | Nair et al. | |
| 2003/0099793 | A1 | 5/2003 | Dronzek, Jr. | |
| 2003/0207091 | A1 | 11/2003 | Nair et al. | |
| 2004/0040460 | A1 * | 3/2004 | Frei et al. | 101/487 |
| 2004/0048001 | A1 * | 3/2004 | Kiguchi et al. | 427/421 |
| 2005/0146588 | A1 * | 7/2005 | Kiguchi et al. | 347/101 |
| 2005/0212871 | A1 * | 9/2005 | Kadomatsu et al. | 347/76 |
| 2006/0046001 | A1 * | 3/2006 | Romano et al. | 428/32.34 |
| 2006/0055734 | A1 * | 3/2006 | Kadomatsu et al. | 347/55 |
| 2007/0076021 | A1 | 4/2007 | Stancik et al. | |
| 2007/0160928 | A1 | 7/2007 | Yamada et al. | |

FOREIGN PATENT DOCUMENTS

| | | | |
|---|---|---|---|
| EP | 1710093 | A1 | 10/2006 |
| GB | 2410705 | A | 8/2005 |

(Continued)

OTHER PUBLICATIONS

English Machine translation of JP 2003-211650.*

*Primary Examiner* — Stephen Meier
*Assistant Examiner* — Sharon A Polk
(74) *Attorney, Agent, or Firm* — Van Cott, Bagley, Cornwall & McCarthy; Steven Nichols

(57) ABSTRACT

A method of increasing the optical density of a printed image includes treating a first layer of deposited ink with a corona discharge. An apparatus for increasing the optical density of a printed image includes a print head for depositing a first layer of ink; and at least one electrode in proximity to the print head for treating the first layer of ink with a corona discharge.

20 Claims, 3 Drawing Sheets

(56) References Cited

FOREIGN PATENT DOCUMENTS

| | | | | | |
|---|---|---|---|---|---|
| JP | 02178651 | A | * | 7/1990 | ..... G03C 1/176 |
| JP | 03261583 | A | * | 11/1991 | ..... B41J 31/16 |
| JP | 10226058 | | | 8/1998 | |
| JP | 11309800 | | | 11/1999 | |
| JP | 15211650 | | | 7/2003 | |
| SU | 1278250 | A | * | 12/1986 | ..... B41J 3/04 |
| WO | 9309925 | A2 | | 5/1993 | |
| WO | 02051644 | A1 | | 7/2002 | |
| WO | 2004061200 | A1 | | 7/2004 | |

* cited by examiner

METHOD AND APPARATUS FOR IMPROVING PRINTED IMAGE DENSITY

RELATED DOCUMENTS

The present application claims the priority under 35 U.S.C. §119(a)-(d) or (f) of International Application No.: PCT/US2007/024214, filed Nov. 19, 2007, entitled "Method and Apparatus for Improving Printed Image Density," which application is incorporated herein by reference in its entirety.

BACKGROUND

Inkjet printing can be used to provide a desired image on a wide variety of different print media and print surfaces. However, inkjet printing on plastic or other polymer based substrates can present issues due to the surface qualities of the polymer substrate.

Typically, polymer substrates have low surface energy. As a result, polymer substrates wet poorly, meaning that deposited ink or other fluids are not absorbed in significant degree by the substrate surface. In inkjet printing, this can result in relatively low densities of ink, variations of density across an image, relatively rapid or non-homogeneous fading of printed images and image smearing on polymer substrates.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
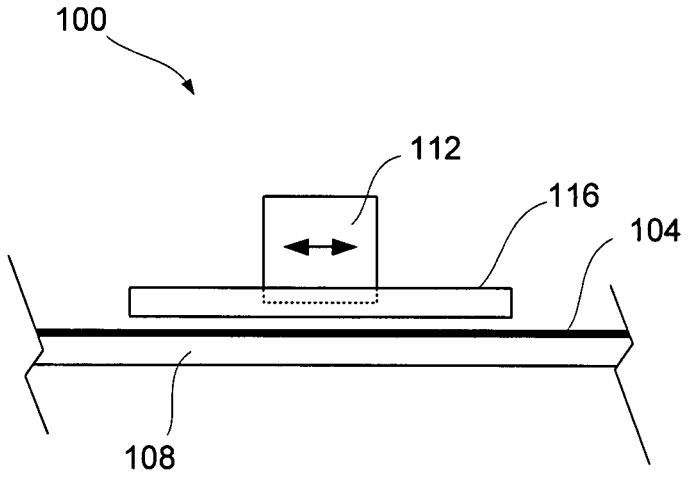
FIG. 1 is an illustrative diagram of one embodiment of a corona printing apparatus, according to principles described herein.

The following specification describes methods and devices for improving printed image optical density on substrates or print media with low surface adhesion and low wetability. These methods and devices include using a charged electrode to apply a corona discharge over either the substrate or a layer of ink applied to the substrate to increase the adherence and consequently optical density of a layer of ink applied after the corona discharge treatment. In particular, where multiple layers of ink and printed on top of each other to form a desired image, applying a corona discharge to a layer of ink that has already been applied to a substrate can significantly increase the adherence and optical density of a subsequent layer of ink. As will be described below, the corona discharge treatment increases the surface energy and wetability of both the substrate and previously-deposited layers of ink to enhance optical density, prevent fading and smearing and otherwise substantially improve the resulting image.

As described above, one issue related to inkjet printing on plastic substrates, and especially polymer based substrates, is the relatively low optical density of the printed image as compared with images printed on other substrates, such as paper, that have a much higher surface energy or a different wetability mechanism. In the example of paper, the wetability mechanism is penetration of the ink into the substrate bulk. Either higher surface energy or a wetability mechanism including penetration of ink into the substrate bulk produces better adhesion or wetability. Related issues with images printed on plastic or polymer-based substrates include variations in the optical density of the printed image across the image, quick and non-homogeneous fading of the images and smearing of the images.

One method of addressing these issues involves applying an additional coating to the surface of the plastic or polymer substrate. These additional coatings are usually applied as a liquid and then dried. Such coatings provide a higher surface energy and wetability to better fix an inkjet printed image on the substrate.

However, these coatings involve additional cost and logistical considerations. Moreover, in many instances, separate coatings are needed for each of various substrate and ink combinations. These coatings must then be stored, tracked, and applied to the surface of the substrate in a separate operation prior to printing.

Additionally, such coatings are typically applied to the entire surface of the substrate, rather than just portions of the substrate where ink will be deposited. For these and other reasons, it is desirable to use a process for improving image optical density that is simpler and less expensive than applying a separate surface coating.

An alternative to applying a separate surface coating is altering the characteristics of the surface itself prior to printing. As described above, the low surface energy of a substrate is one of the main reasons for poor surface adhesion of ink on the substrate. The surface contact or adhesion between an ink and a substrate is at least partly governed by the relative differences between the surface tension of the liquid ink and the surface energy of the substrate. When the liquid ink has a high surface tension (strong internal bonds), the ink will have a greater tendency to form a droplet on the surface of a substrate, particularly a substrate with lower surface energy. Conversely, if the substrate has a higher surface energy than the surface tension of the liquid ink, the liquid ink will have a greater tendency to spread and wet the surface. This phenomenon follows the principle of "minimization of interfacial energy." The higher energy surface of the substrate encourages wetting by the liquid, because the substrate/liquid contact will lower the surface energy at that interface.

Unmodified plastics, particularly polyolefin polymers, have very low surface energy because of their non-polar nature. It can be very difficult to make an ink bond effectively with the surface of a plastic or polyolefin based substrate. For example, the surface energy of freshly made polypropylene-based substrate is in the range of about 30 dynes/centimeter. For good surface adhesion and wetting with the printing ink, surface energy of the substrate should be appreciably higher, depending on the surface tension of the liquid ink. By way of example and not limitation, substrate surface energies of 40 dynes/centimeter or more permit adequate adhesion and wetting by solvent based inks.

One method of increasing the surface energy of a substrate is to use a corona discharge treatment. In a corona discharge treatment, the substrate is fed into a controlled air gap between two electrodes, one of which is energized with a high-voltage electrical field and the other of which is grounded. As high-voltage power is applied across space between the electrodes, a portion of the air between the electrodes becomes ionized to form a corona region. The ionized air gap is produced by accelerating electrons that create an electron avalanche which, in turn, creates more ionic molecules in the air gap such as ozone.

The corona treatment can increase the surface energy of the substrate in a variety of ways, including electron bombardment and direct chemical action. Electron bombardment occurs when electrons are accelerated into the surface of the substrate causing the polymer chains on the surface of the substrate to rupture, producing a multiplicity of openings and free valences. The free valences are then able to form carbonyl groups with ozone created by the corona discharge or with other molecules. This increases the surface energy of the substrate and improves the adhesion of the deposited ink. Direct chemical action can also occur when the ozone or other molecules directly interact with the surface of the substrate and thereby increase the surface energy and surface adhesion.

The extent of polymer chain rupture can be controlled using a variety of variables. By way of example and not limitation, these variables may include the voltage applied across the electrodes, the distance between the electrodes, the type and thickness of the substrate that is introduced between the electrodes, the composition of the gas between the electrodes and other factors. By controlling the extent of polymer chain rupture, the surface energy of the substrate can be optimized for printing, while negative effects on the mechanical integrity of the substrate are reduced.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

FIG. 1 is a diagram of an illustrative corona printing apparatus (100) according to principles described herein. According to this illustrative embodiment, the substrate (104) rests on a support member (108). The support member (108) may be a bed, table, drum or other suitable device. In this exemplary embodiment, the support member (108) additionally serves as a stationary electrode. Typically, this stationary electrode (108) is the grounded electrode.

A print head (112) with an attached upper or charged electrode (116) reciprocates over the surface of the substrate (104). As the print head (112) moves over the substrate (104), the voltage difference between the upper electrode (116) and the support element (108) produces a corona in the intervening airspace. According to one exemplary embodiment, the corona simultaneously creates ozone and accelerates electrons into the substrate. This mechanically and/or chemically alters the surface energy of the substrate (104), facilitating the wetting and adhesion of the ink applied by the print head (112).

As the print head (112) moves over the substrate (104), a corona is created between the paired electrodes (116, 108). The corona moves with the print head (112) ahead of the inkjet nozzles of the print head (112) such that the surface of the substrate (104) is treated by the corona before the print head (112) deposits ink on the treated portions of the substrate (104). The print head (112) may make repeated passes over the substrate (104) to print the desired image.

The upper electrode (116) may have a variety of configurations that will be described herein. In one exemplary embodiment, the upper electrode (116) covers substantially more area than is printed in the current pass by the print head (112). Thus, unprinted regions of the substrate are treated by exposure to corona discharge in addition to regions where ink is deposited.

According to one exemplary embodiment, the printer is operated in a one pass printing configuration. The upper electrode (116) is configured to pre-treat the substrate (104) surface immediately prior to the deposition of ink droplets. Additionally, the upper electrode (116) can be configured to post treat the deposited ink. In this case, a corona is created between the electrodes (116, 108) behind the movement of the print head (112) to treat the layer of ink that has just been deposited. Post treating the ink may result in more stable printed ink chemistry, easier printing of a second layer of ink on top of the first treated layer of ink, quicker evaporation of the volatile components of the ink, and/or facilitation of chemical reactions within the ink.

In two-pass printing, where the print head (112) passes over and deposits ink on the same region of the substrate (104) more than once, corona treatment of the deposited ink can contribute to the adhesion and wetting of the second layer of ink on the previously deposited ink layer in the same manner. In two-pass printing, the post-treatment of a previously deposited ink layer may occur on the second pass with the corona created at the front of the advancing print head (112). In such embodiments, it may not be necessary to create a corona behind the advancing print head (112) as described above.

Figure 2:
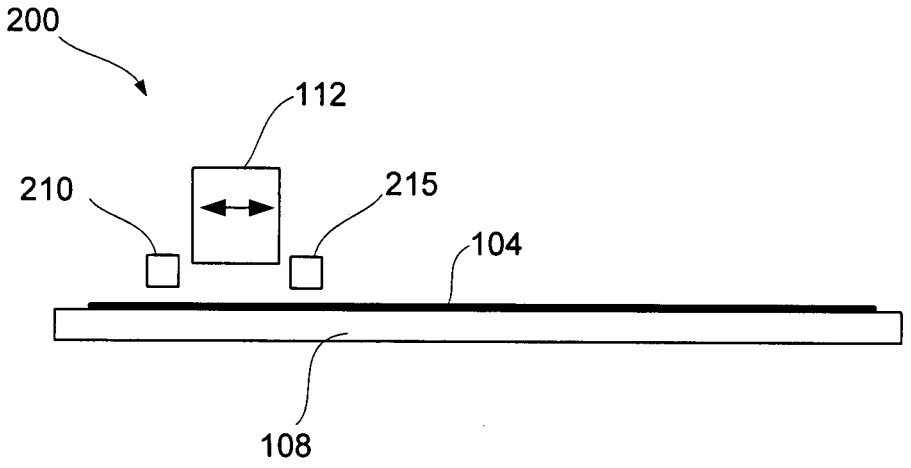
FIG. 2 is an illustrative diagram of an embodiment of a corona printing apparatus with dual electrodes, according to principles described herein.

FIG. 2 is a diagram of an exemplary corona printing apparatus (200) with dual electrodes (210, 215) according to principles described herein. According to this exemplary embodiment, two separate upper electrodes (210, 215) are placed on either side of the print head (112). In this configuration, the individual electrodes (210, 215) can be selectively energized for more versatile corona treatment of the substrate or previously deposited ink.

Figure 3:
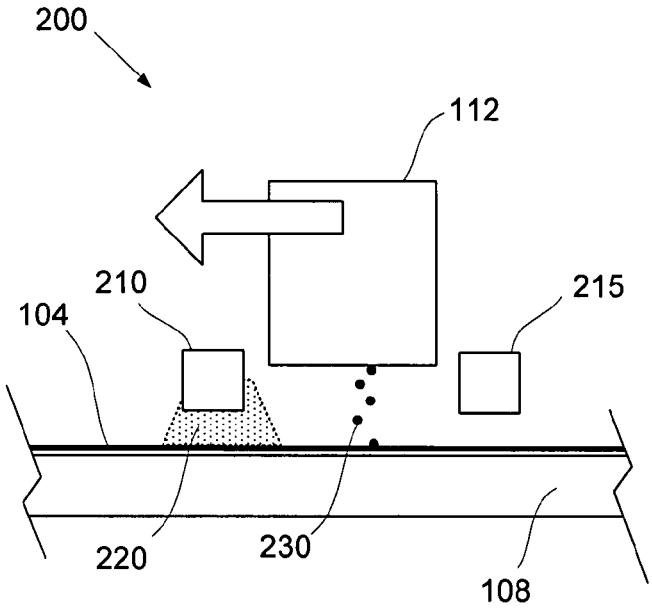
FIG. 3 is an illustrative diagram of an embodiment of a corona printing apparatus moving in a first direction, according to principles described herein.

FIG. 3 shows the printing apparatus (200) of FIG. 2 moving across the substrate (104) to the left, as indicated by the arrow. As noted with respect to FIG. 2, the print head (112) is flanked on either side by electrodes (210, 215). According to one exemplary embodiment, the electrodes (210, 215) are mechanically attached to the print head (112) and move with it across the substrate (104).

In this exemplary embodiment, the left electrode (210) is charged, generating a corona discharge (220). As discussed above, the corona discharge (220) generates ozone, other charged particles, and/or electrons that bombard the surface of the substrate (104). This corona discharge treatment changes the surface energy of the substrate (104), facilitating the wetting of the surface by the ink (230) and the adhesion to the surface of the ink (230).

To the right of the corona discharge (220), the print head (112) deposits droplets of ink (230) to form an image on the substrate (104). As described herein, these ink droplets (230) are better able to bond with, and form an image on, the substrate (140) due to the corona discharge (220) that increases the surface energy of the substrate (104) ahead of the ink droplets (230) being deposited.

Figure 4:
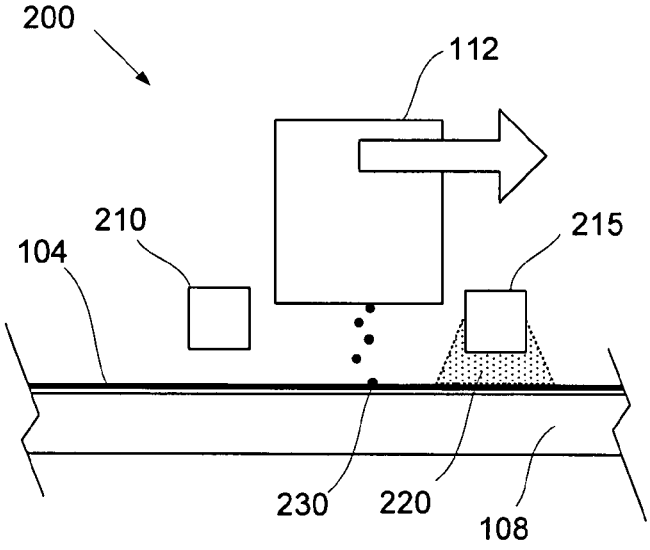
FIG. 4 is an illustrative diagram of an embodiment of a corona printing apparatus moving in a second direction, according to principles described herein.

FIG. 4 is a diagram of the exemplary printing apparatus (200) with the print head (112) moving to the right as indicated by the arrow. In this exemplary embodiment, the right electrode (215) is charged, generating a corona discharge (220). To the left of the corona discharge (220), the print head (112) deposits droplets of ink to form an image on the substrate (230).

FIG. 4 could illustrate a second pass of the print head (112) over a region of the substrate (104) that has previously received a layer of ink. The previously received layer of ink could have been deposited as illustrated in FIG. 3. As the print head (112) moves across the same region of substrate for a second time, the corona discharge (220) generated by the right electrode (215) treats the surface of the exposed substrate and the previously deposited ink prior to the deposition of the second ink layer. This double pass technique facilitates the deposition and wetting of additional ink deposited on previously printed surfaces.

Alternatively, FIG. 4 could illustrate the passage of the print head (112) over previously untreated and unprinted area of the substrate (104). The process of corona treatment and deposition of ink for a single pass treatment is described in FIG. 3 above. In some embodiments using a single pass, both left and right electrodes (210, 215) may be energized to produce a corona discharge both in front of and to the rear of the advancing print head (112). In this way, the coronas respectively treat the substrate (104) in advance of the deposition of ink droplets (230) and then treat the layer of ink formed by the deposited droplets (230) as described above.

The motion of the print head (112) described should not be construed as limiting the examples contained herein. A variety of methods of printing are compatible with the principles described. By way of example and not limitation, the substrate could be moved beneath the print head rather than print head moving above the substrate. Further, the geometry of the components could be altered. For example, the apparatus illustrated in FIG. 1 could be used for two-pass printing. The electrode (116, FIG. 1) could both pre-treat the substrate and post treat the surface of the deposited ink upon which an additional layer of ink would be deposited.

Additionally, the electrodes could be constructed in a variety of geometries and attached to the print head in a variety of configurations. In one exemplary embodiment, the upper electrode or electrodes have at least one sharp point or edge. This sharp point or edge creates a higher electrical gradient in the ionized plasma surrounding the electrode and allows for further manipulation of the corona discharge. Air near the sharp point or edge of the electrode becomes increasing ionized and concentrates the effects of the corona discharge.

According to one exemplary embodiment, the image optical density is improved by treating the printed substrate at each pass of the print head (112). According to another exemplary embodiment, the upper electrodes (210, 215) are sized so that the corona treatment is substantially limited to the area of the substrate (104) that will be immediately printed by the print head (112). In this embodiment, only the areas on which ink will be deposited thereafter are treated by corona discharge. By selectively exposing to corona discharge only those areas of the substrate that will receive ink, the energy consumed by the process is minimized, the size of the electrode can be reduced and the potential damage to areas that are not covered by ink is minimized.

In an alternative embodiment, the electrodes may create a corona discharge that is substantially larger than the area currently being printed. In this embodiment, the corona discharge could cumulatively treat the uncoated and the printed areas of the substrate.

Further, to advantageously treat the substrate surface or layer of deposited ink, the corona discharge may be generated as either a positive or a negative corona. Positive coronas are manifested as uniform plasma across the length of a conductor. Electrons resulting from ionization are attracted toward the electrode, and the slower positive ions are repelled from it. Thus, the electrons in a positive corona are concentrated close to the surface of the conductor in a region of high potential gradient. This region of high potential gradient generates electrons with a high energy. Positive coronas, in general, generate less ozone than negative coronas. For applications where electrons with high activation energy are desired, a positive corona may support greater reaction constants than negative coronas.

Negative coronas may also be used to treat the substrate surface or layer of deposited ink. Negative coronas are typically characterized by a non-uniform corona region that varies according to the surface features of the electrode. Negative coronas repel the electrons generated by ionization. The electrons pass out of the ionizing region, creating plasma some distance beyond it. Consequently, the total number of electrons and electron density in a negative corona is much higher than a positive corona. As the electrons move outward, they combine with molecules such as oxygen and water vapor to produce negative ions. These negative ions are then attracted to the positive electrode or ground.

Figure 5:
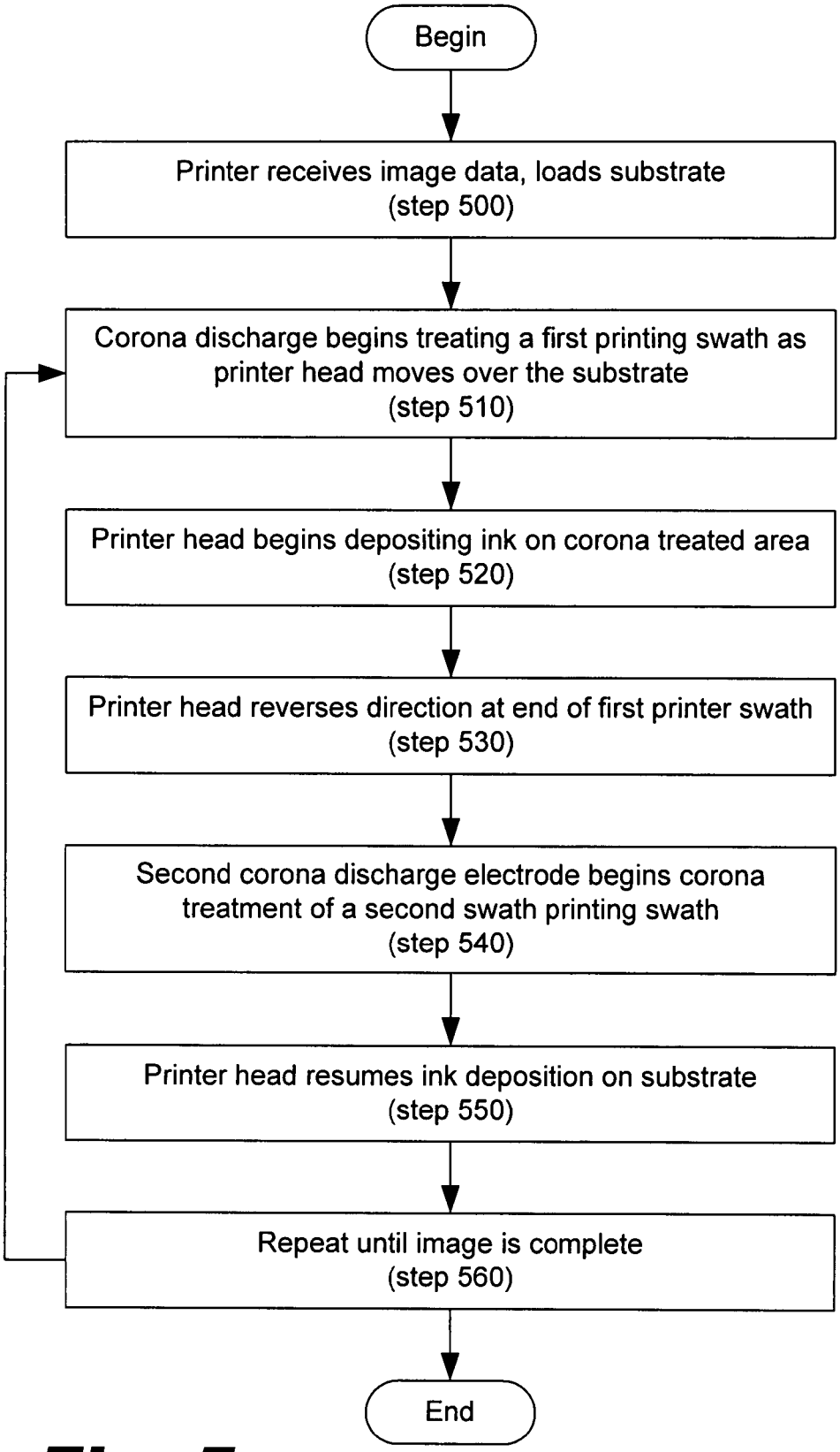
FIG. 5 is a flowchart showing an illustrative printing method using corona discharge electrodes mounted to a print head, according to principles described herein.

FIG. 5 is a flowchart showing an exemplary printing method using a print head with corona discharge electrodes mounted to either side of the print head, as shown, for example, in FIGS. 2, 3, and 4. The process begins when the printer receives the image data and the substrate is loaded into the printer (step 500).

A voltage is then placed across a first electrode which generates a corona discharge (step 510). This electrode is positioned on the print head so as to create the corona discharge ahead of the inkjet nozzles of the advancing print head.

The print head begins to move across the substrate surface. As the print head moves, the corona discharge treats the surface of the substrate prior to the print head depositing ink on the corona treated area (step 520) as shown in FIG. 3.

At the end of the first swath or motion, the print head reverses its direction (step 530). The voltage may then removed from the first electrode and placed across the second electrode, which begins the corona treatment of the substrate (step 540) as shown in FIG. 4. The print head resumes ink deposition on the substrate (550).

As discussed above, the printer can be operating in either single or double pass mode. Additionally, if better results would be obtained, both electrodes could remain charged through the entire printing operation. The process of the print head moving back and forth across the substrate, treatment of the substrate by corona discharge, and deposition of ink is repeated until the image is complete (560).

A series of tests were performed to validate and quantify corona discharge as a technique for increasing printed image optical density. The tests utilized an apparatus similar to that described in FIG. 1, with the print head remaining static and the substrate being moved beneath the print head.

An X2 HP-Scitex™ piezo print head with native resolution of 100 dots per inch was used to deposit the ink. The droplet deposition frequency of the print head was set at 17 kilohertz. The average ink droplet volume was 55 pico-liters. The print apparatus used a 3 millimeter gap between the print head and the substrate. In order to eliminate the crosstalk between the neighboring nozzles in the print head, the print file was composed from two sub-files. The first file activated the odd nozzles and the second file activated the even nozzles. The voltage across the electrodes was 15 kilovolts with an air gap between the electrode and the substrate of 1 millimeter.

The optical density of the printed images was measured by a Beta Colors™ model P455 densitometer. Two different polymer substrates were tested, a PVC based substrate from the HP-Scitex™ compatible line, and a Banner™ substrate manufactured by Dickson.

The results of the corona discharge printing method were compared to ink deposited on untreated control regions of the same substrate. Both one pass and two pass printing methods were used.

In one pass printing, the corona discharge pretreated the substrate surface prior to the deposition of the ink by the print head. The print head passed over a given portion of the substrate only once and deposited a single layer of ink on selected portions of the substrate surface. One pass printing was performed at the 100 dots per inch native resolution of the print head. The final ink coverage as a percentage of the total area was 17.5% for the one pass printing.

In two pass printing, the substrate was exposed to a corona discharge during each printing pass, such that the surface energy of the printed/cured ink was also changed before an additional layer of ink was deposited. The two pass method resulted in an image resolution of 200 dots per inch. The final ink coverage for the two pass printing was 35%.

The elapsed time between the corona discharge treatment and the deposition of ink of the printed surface can also have an effect on the image density. To quantify the effect of elapsed time between corona discharge treatment and the deposition of the ink, tests were performed where printing occurred immediately following the plasma treatment, printing two days after the plasma treatment and printing one week after the plasma treatment.

The table below summarizes the densitometer readings for one pass printing.

| | Optical Density | | | | | |
|---|---|---|---|---|---|---|
| Substrate | PVC | | | Banner ™ | | |
| Untreated Media | 0.29 | | | 0.3 | | |
| | Immediate printing | Two days later | Seven days later | Immediate printing | Two days later | Seven days later |
| Treated media | 0.35 | 0.42 | 0.42 | 0.4 | .032 | 0.33 |

The table below summarizes the densitometer readings for two-pass printing.

| | Optical Density | | | | | |
|---|---|---|---|---|---|---|
| Substrate | PVC | | | Banner ™ | | |
| Untreated Media | 0.71 | | | 0.73 | | |
| | Immediate printing | Two days later | Seven days later | Immediate printing | Two days later | Seven days later |
| Treated media | 0.9 | 1.0 | 1.03 | 1.03 | 0.99 | 0.83 |

The measurements clearly demonstrate that corona discharge treatment improves the optical density of images printed on polymer substrates. The treated media values can be compared with the untreated values to estimate improvement in the optical density as a result of corona treatment. The improvement in optical density ranged from about 10% to 45%. Additionally, the corona discharge treatment resulted in improved and uniform dot gain.

In the one-pass printing, improvements in optical densities ranged from about 10% for the Banner™ substrate that was printed seven days after corona treatment to about 45% for a polyvinylchloride (PVC) substrate that was printed seven days after corona treatment. Printing immediately following the corona discharge treatment resulted in respective improvements of 20% and 33% for the PVC and Banner™ substrates.

Improvement in the optical density was also seen in two-pass printing, where the previously deposited ink layer was exposed to corona discharge treatment prior to the deposition of the second ink layer. The results seem to suggest that corona discharge treatment could be additionally effective when deposited ink layers are exposed to the corona discharge before the subsequent deposition of additional ink layers.

The effect of elapsed time between the corona discharge treatment and the deposition of ink on the printed surface appeared to be substrate dependent. The PVC substrate showed an increase in optical density for printing that occurred after a period of elapsed time, while the Banner™ substrate showed a decrease in optical density for printing that occurred after a period of elapsed time. For example, the two-pass printing data indicates that the optical density of ink deposited on the PVC substrate was 0.90 for printing that occurred immediately following the corona discharge treatment and 1.03 for printing that occurred seven days after corona discharge treatment. This is an increase in optical density of about 13%.

Conversely, the Banner™ substrate showed a progressive decrease in optical density for over the tested time periods. For example, the two pass printing data indicates that the optical density of an ink layer deposited on the Banner substrate was 1.03 for printing that occurred immediately following the corona discharge treatment, 0.99 for printing that occurred two days following the treatment, and 0.83 for printing that occurred seven days after corona discharge treatment. This corresponds to a decrease in optical density of about 4% and 20%, respectively.

The advantages of corona discharge treatment as a method of increasing the optical density of a printed image include the ability to selectively modify printing parameters to improve printing on a variety of substrates. By way of example and not limitation, the corona discharge treatment can be adapted to a variety of substrates by controlling printing parameters such as the elapsed time between treatment and printing, the corona discharge voltage, the gap between the electrode and the substrate, the number of printing passes used to deposit the ink, the geometry of the electrode, pretreatment and/or post treatment of the deposited layers, and other parameters.

Other advantages of corona discharge treatment include independence from liquid coatings which are expensive, vary from substrate to substrate and can cause environment harm. Logistics issues, such as purchasing liquid coatings, storing the liquid coatings and treating substrates with the liquid coatings are eliminated by the use of the corona discharge method. Further, the corona treatment can be selectively applied to only the sections of the substrate surface upon which printing will occur. This saves time and money by only treating the portion of the substrate upon which ink will be deposited.

Further, by integrating the corona discharge electrodes with the print head, the printing process can be more convenient and simple. The substrate can be simply loaded into the printer, with the areas where ink will be deposited being automatically treated to improve the optical density of the printed image.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method of increasing the optical density of a printed image comprising treating a first layer of deposited ink with a corona discharge generated by at least one electrode attached to a print head that is to move across a width of the substrate, wherein the at least one electrode is sized less than the width of the substrate.

2. The method of claim 1, further comprising:

treating selected portions of the substrate with the corona discharge; and then, depositing said first layer of ink on the substrate using the print head within said selected portion.

3. The method of claim 2, wherein said substrate has at least one polymer based surface.

4. The method of claim 1, wherein said corona discharge comprises a positive corona to produce higher activation energies than would a negative corona.

5. The method of claim 1, wherein said at least one electrode covers substantially more area than is printed in a current reciprocating pass of the print head so as to treat both unprinted regions of the substrate in addition to regions where ink is already deposited.

6. The method of claim 1, further comprising concentrating effects of the corona discharge with at least one point or edge of the at least one electrode that creates a higher electrical gradient in ionized plasma surrounding the electrode.

7. The method of claim 1, wherein said at least one electrode comprises a first electrode and a second electrode, said print head being interposed between said first and second electrodes, said method comprising alternately activating said first and second electrodes according to relative motion between a surface receiving said ink and said print head.

8. The method of claim 1, further comprising depositing said first layer of deposited ink and treating said first layer of deposited ink with said corona discharge during one pass of the print head.

9. The method of claim 1, further comprising depositing a subsequent layer of ink over said first layer of deposited ink following the treating of said first layer of deposited ink with said corona discharge.

10. The method of claim 9, further comprising treating said subsequent layer of ink with a corona discharge.

11. The method of claim 10, further comprising depositing said subsequent layer of ink and treating said subsequent layer of ink with said corona discharge during one pass of the print head.

12. The method of claim 10, further comprising depositing said subsequent layer of ink during one pass of the print head and treating said subsequent layer of ink with said corona discharge during a subsequent pass of said print head.

13. The method of claim 1, further comprising providing a delay of time between depositing said first layer of ink and said treating with a corona discharge, wherein said delay is based on a substrate receiving said ink.

14. The method of claim 1, further comprising setting a corona discharge voltage based on a substrate receiving said ink.

15. The method of claim 1, further comprising determining a gap between a corona discharge electrode and a substrate receiving said ink based on a substrate receiving said ink.

16. An apparatus for practicing the method of claim 1 for increasing the optical density of a printed image, the apparatus comprising:

the print head for depositing a first layer of ink; and the at least one electrode in proximity to said print head for treating said first layer of ink with a corona discharge.

17. The apparatus of claim 16, further comprising:

a support member configured to act as a lower electrode;

a substrate interposed between said upper electrode and said lower electrode.

18. The apparatus of claim 16, wherein said apparatus is configured to deposit said first layer of ink and treat said first layer of ink with said corona discharge during a single pass of said print head.

19. The apparatus of claim 16, wherein said at least one electrode comprises a first electrode and a second electrode, said print head being interposed between said first and second electrodes such that one of said electrodes precedes said print head in either direction across a print swath.

20. The apparatus of claim 19, wherein said first and second electrodes are alternately activated according to a direction of movement of said print head.

* * * * *